United States Patent [19]

Walsh et al.

[11] Patent Number: 4,765,481

[45] Date of Patent: Aug. 23, 1988

[54] PACKAGED AIRLINE HEADSETS

[76] Inventors: John T. Walsh, 115 Kane Ave., Middletown; Ronald J. Hourihan, 146 Rhode Island Ave., Newport, both of R.I. 02840

[21] Appl. No.: 897,529

[22] Filed: Aug. 18, 1986

[51] Int. Cl.[4] ..... B65D 85/00

[52] U.S. Cl. ..... 206/525; 150/52 R; 383/41; 383/86; 455/351

[58] Field of Search ..... 150/52 R; 206/329, 305, 206/320, 525; 383/36, 40, 41, 66, 71, 86, 87, 37; 224/252, 253; 242/1; 379/452; 381/183, 189; 426/415; 455/351

[56] References Cited

U.S. PATENT DOCUMENTS

| | | | |
|---|---|---|---|
| 1,688,699 | 12/1928 | Gardner | 383/40 X |
| 2,620,842 | 12/1952 | Hoeppner et al. | 383/40 X |
| 2,652,089 | 9/1953 | Cramer | 383/40 X |
| 3,259,920 | 7/1966 | Voller | 383/41 X |
| 3,358,906 | 12/1967 | Faiers | 383/86 |
| 3,426,282 | 2/1969 | Brady | 455/351 |
| 3,647,060 | 3/1972 | Kiely | 383/86 X |
| 3,734,282 | 5/1973 | Rebold | 150/52 R |
| 3,880,370 | 4/1975 | Keister et al. | 242/1 |
| 3,935,810 | 2/1976 | Milano | 383/37 |
| 4,066,811 | 1/1978 | Naito et al. | 426/415 |
| 4,384,604 | 5/1983 | DeLaura et al. | 150/52 R |
| 4,420,078 | 12/1983 | Belt et al. | 206/305 |
| 4,503,559 | 3/1985 | Warnke | 383/41 X |
| 4,570,792 | 2/1986 | Conway | 150/52 R X |
| 4,622,027 | 11/1986 | Parish | 383/41 X |

*Primary Examiner*—Jimmy G. Foster

[57] ABSTRACT

Airline headsets are packaged in a reusable container. The container is affixed to the cord of the headset near the connection which inserts into the plug in the passenger seat arm. The reusable container provides for advertising which underwrites the cost of the head set and the container to an extent that it is less costly to give the passengers the headsets on a complimentary basis than to handle them in the familiar manner.

7 Claims, 2 Drawing Sheets

PACKAGED AIRLINE HEADSETS

FIELD OF INVENTION

This invention relates to headsets used in airplanes for in-flight entertainment and more particularly to the packaging of such headsets for reuse.

BACKGROUND OF THE INVENTION

Most air travellers have had an opportunity to use headsets typically for accessing the sound track which accompanies the in-flight movie and audio channels. The headsets are collected towards the end of the flight, as is well-known.

Often, the headsets are packaged in plastic bags which are torn open to allow use. The earphones typically are collected without the bags and placed in a collection box where they become tangled. In order to reuse the headsets, they have to be untangled and cleaned, a process which inevitably leads to the destruction of a certain percentage of the headsets. The cost of handling the headsets, the destruction of same and the loss of others result in an expense which is of considerable concern to the airline industry.

The present invention provides for the use of a durable but flexible plastic container for each headset. The cord for the headsets extends through a nipple at the side of the container in order to permit electrical (or pneumatic) connection to be made to the plug provided for each passenger. The cord is secured to the nipple at a distance closely spaced apart from the connector, in order to properly secure the container in an out-of-the-way position when the headsets are withdrawn.

The container is constructed in the form of a pouch with a flap which is secured in a position to overlap the pouch. In one embodiment, the flap itself contains an inside pouch adapted to restrain the earphones if the flap is not secured in place. The container is adapted to permit easy reinsertion of the headset either by the passenger or by the flight attendant. In addition, the container lends itself to advertising which underwrites part of the cost of the headset. In fact, the ease of handling enabled by the use of the container along with the financial advantage of advertisements reduces the cost of the headsets to a level where it's less costly for the airline to give-away the headset than to handle it.

DETAILED DESCRIPTION

Figure 1:
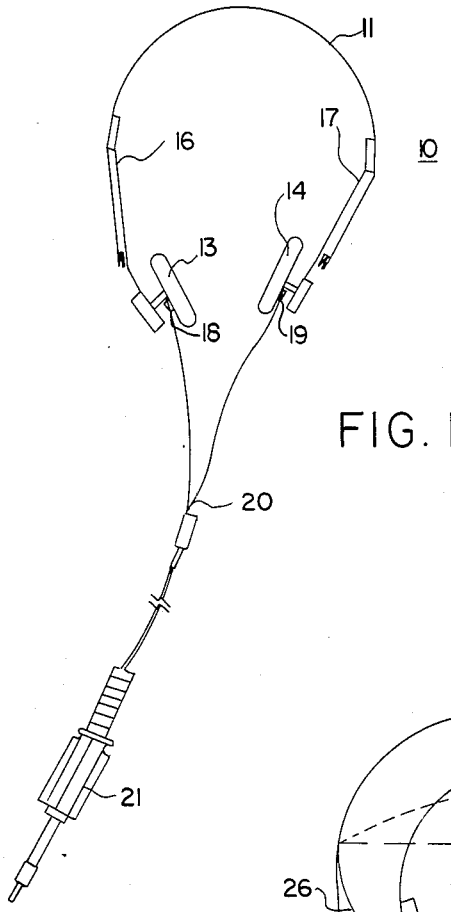
FIG. 1 is a schematic representation of a representative headset for packaging in accordance with this invention.

FIG. 1 shows a commercially available headset 10 of a type usable for airlines. The headsets are usually seen in the streets frequented by joggers for listening to portable radios as they jog. The headsets are adapted electrically to be compatible to the airlines voltage but otherwise are physically the same as those familiar headsets. Alternatively, pneumatic headsets common on airlines can be used.

The headset in either case comprises a flexible band 11 which fits around the head. Earpieces are slidably attached to the opposite ends of band 11. The earpieces are designated 13 and 14 in the FIG. and are supported by slides 16 and 17 respectively. Stops 18 and 19 are affixed to the end of the band 11 to restrain slides 16 and 17 from disengaging the band.

The headset is adapted to engage a transducer plug (not shown) provided for in the arm of each passenger seat. The most familiar plug comprises two transducer holes into which a headset pneumatic cord is inserted. The cord in this instance comprises two hollow tubes which conduct sound to the ear pieces. We have chosen, arbitrarily, to represent the illustrative headset as an electromagnetic rather than a pneumatic device because an electromagnetic system provides better sound and is becoming increasingly competitive with pneumatic headsets.

The cord 20 of headset 10 terminates in a connection which in the illustrative case is shown as a jack 21. The jack is adapted for insertion in a transducer plug (not shown) located in the arm of the passenger seat.

Figure 2:
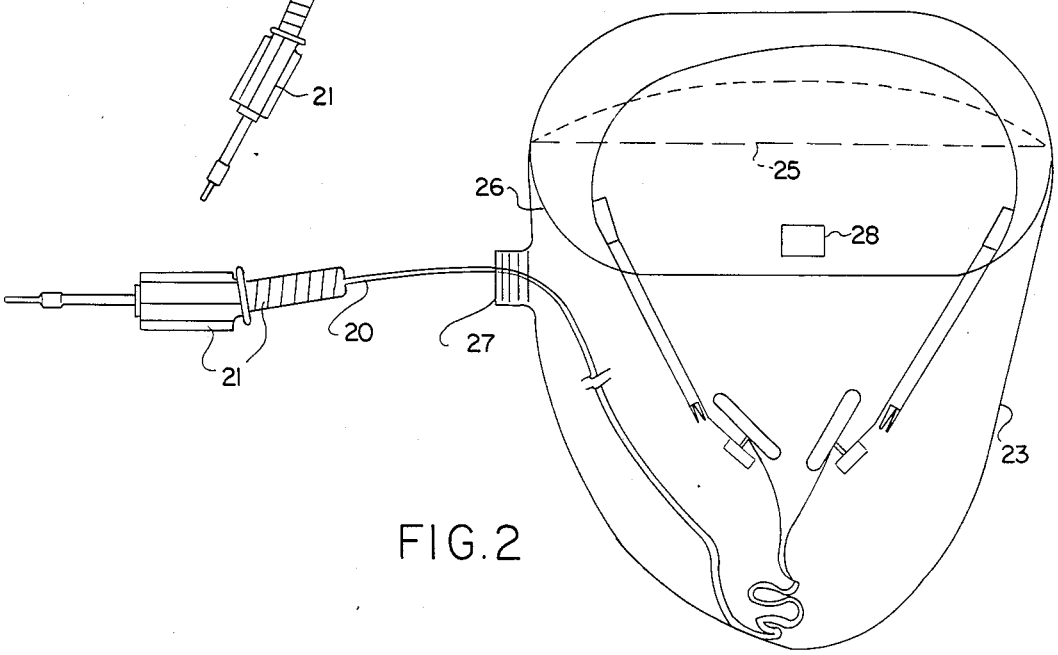
FIG. 2 is a schematic representation of a headset packaged in accordance with this invention.

FIG. 2 shows the representative headset of FIG. 1 in position in a container 23. The container comprises two flat sheets of double polished vinyl bonded at the perimeter to form a pocket. The container is conveniently eight inches wide by nine inches long (at its widest and longest point), for easy insertion of the headset.

The front sheet of the container is shorter than the back sheet as indicated by broken line 25 to provide easy access to the headset.

Importantly, the container includes a nipple 27 through which cord 20 extends for exposing jack 21 for connection to a plug. Cord 20 is secured to the nipple so that only a few inches of cord 20 are exposed beyond the nipple. In this manner, container 23 is positioned in an out-of-the-way position by the plug when the headset is in use.

The cord may be secured to the nipple in a variety of ways. One way is to emboss the cord and the nipple with ripples which engage one another to limit movement. Alternatively, the nipple can be heat bonded, glued or stapled to the cord to prevent movement. Any of these techniques could be adapted to pneumatic or electromagnetic systems.

Double polished vinyl develops an electrostatic charge which causes clinging. Consequently, flap 26 can be adapted to cling to the front sheet (face) of container 23. If a material is used which does not cling, a snap can be provided to secure the flap. A suitable snap is designated 28 in FIG. 2. Particularly, when the container (or pouch) is made of a material which does cling, the flap conveniently is itself made in the form of a pouch adapted to receive a portion of the headset when the flap is not secured in a closed position.

Figure 3:
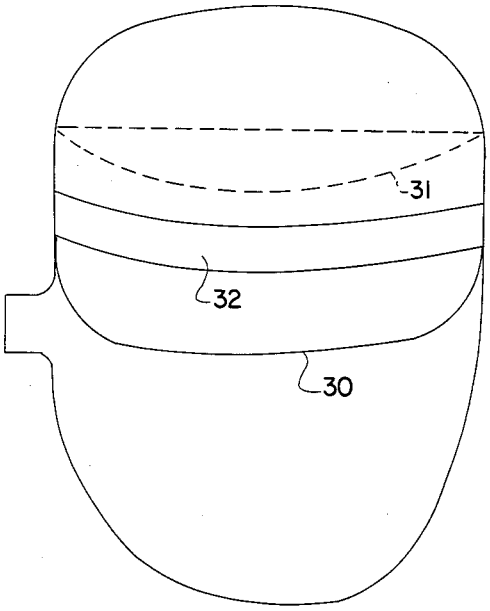
FIG. 3 is a schematic representation of an alternative package for a headset.

FIG. 3 shows such a container. Flap 30 includes a hidden face, the top edge of which is represented by broken line 31. The hidden face is adapted to form a pocket in the flap when the flap is in an open position, in order to restrain a headset from falling out of the container accidentally.

The container conveniently is adapted with a band 32 to facilitate carrying of the container. The container is made of sturdy vinyl material because it is contemplated that the airlines will make the headset available to the passengers on a complimentary basis. Headsets presently cost less than two dollars each. Advertisers have indicated an eagerness to advertise on the containers. Moreover, the pouch can be slotted to receive coupons. All-told revenues from advertising appear likely to compensate for the cost of the headsets and the container. Complimentary headsets certainly appear to provide an attractive alternative to the handling of the headsets which is required presently.

What is claimed is:

1. A combination including a flexible plastic container and an airline headset operable to be connected to a sound system of an airplane, said container comprising a pouch having an inner pocket for receiving said headset and having an opening for placing said headset in said pouch, and a flap connected to said pouch and operable to open and close said first opening, said headset including a cord adapted at one end for connection to the sound system of the airplane, said pouch having a second opening spaced apart from said first opening, said cord extending from the interior of said pouch through said second opening to the exterior of said pouch for enabling said cord to be connected to the sound system and for preventing said pouch and said headset from becoming separated from one another when said headset is removed from said pouch for use, said headset being returnable to said pouch for storage after use, said pouch comprising a nipple defining said second opening and said headset further includes a jack located at an end of said cord for connecting into the sound system of the airplane, said cord and said nipple being adapted to engage each other at a predetermined positon in proximity to said jack.

2. The combination in accordance with claim 1, including snap means for securing said flap to maintain said first opening closed.

3. The combination in accordance with claim 1, wherein said pouch comprises a vinyl material of a type to accumulate an electrostatic charge and said flap is adapted to cling to said pouch due to said electrostatic charge to maintain said first opening closed.

4. The combination in accordance with claim 1, wherein said cord and said nipple are engaged together at said predetermined position.

5. The combination in accordance with claim 1, wherein said flap defines a second pouch adapted to engage a portion of said headset in a manner to inhibit accidental removal of said headset from said pouches.

6. The combination in accordance with claim 1, wherein said pouch comprises first and second sheets of material having edges, said first and second sheets being secured to each other near said edges to define said pouch.

7. The combination in accordance with claim 6, wherein said sheets of material include opposing tabs adapted to define said nipple and said second opening.

* * * * *